US006293563B1

(12) United States Patent
Benoit

(10) Patent No.: US 6,293,563 B1
(45) Date of Patent: Sep. 25, 2001

(54) CHASSIS FOR A GLIDING SPORT ELEMENT, SUCH AS A SKATE, AND A GLIDING ELEMENT INCLUDING SUCH CHASSIS

(75) Inventor: Louis Benoit, La Balme de Sillingy (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/377,841

(22) Filed: Aug. 20, 1999

Related U.S. Application Data

(62) Division of application No. 08/736,995, filed on Oct. 25, 1996.

(30) Foreign Application Priority Data

Nov. 14, 1995 (FR) ..... 95 13707

(51) Int. Cl.[7] ..... A63C 17/02

(52) U.S. Cl. ..... 280/11.221; 280/11.222; 280/11.27

(58) Field of Search ..... 280/11.22, 11.222, 280/7.13, 11.27, 11.17, 11.221, 11.225, 11.28, 11.19; 29/421.1, 428

(56) References Cited

U.S. PATENT DOCUMENTS

| | | | | |
|---|---|---|---|---|
| 275,483 | | 4/1883 | Gregg | 280/11.19 |
| 875,165 | | 12/1907 | Faust et al. | 280/11.19 |
| 1,294,984 | | 2/1919 | Ware | 280/11.19 |
| 1,728,629 | * | 9/1929 | Sahlmann | 280/11.221 |
| 1,807,890 | | 6/1931 | Berger | 280/11.27 X |
| 1,977,587 | * | 10/1934 | MacDonnell | 280/11.17 |
| 2,291,600 | | 8/1942 | Atkinson | 280/11.23 X |
| 2,531,357 | | 11/1950 | Foulds | 280/11.27 X |
| 4,273,345 | | 6/1981 | Ben-Dor et al. | 280/11.2 |
| 5,326,115 | * | 7/1994 | Seltzer | 280/11.27 |
| 5,388,846 | | 2/1995 | Gierveld | 280/11.22 |
| 5,560,625 | * | 10/1996 | Kuykendall | 280/11.22 |
| 5,735,536 | * | 4/1998 | Myers et al. | 280/11.27 |
| 5,810,369 | * | 9/1998 | Wilder et al. | 280/11.22 |
| 5,848,796 | * | 12/1998 | Meibock et al. | 280/11.22 |
| 5,913,526 | * | 6/1999 | Olson et al. | 280/11.22 |
| 6,053,512 | * | 4/2000 | Chang | 280/11.22 |

FOREIGN PATENT DOCUMENTS

| | | |
|---|---|---|
| 105264 | 6/1924 | (CH) . |
| 1033569 | 7/1958 | (DE) . |
| 0043250 | 1/1982 | (EP) . |
| 495821 | 10/1919 | (FR) . |
| 943511 | 3/1949 | (FR) . |

* cited by examiner

*Primary Examiner*—Lanna Mai
*Assistant Examiner*—Hau Phan
(74) *Attorney, Agent, or Firm*—Greenblum & Bernstein, P.L.C.

(57) ABSTRACT

A chassis for a gliding sport element, such as a skate, and, more particularly, such as an in-line roller skate, which includes such chassis. The chassis includes at least one support surface capable of receiving a boot and at least one lateral flange having at least one stiffening rib formed on at least one of the flanges. The gliding member(s), such as wheels, are mounted to the lateral flange(s).

43 Claims, 3 Drawing Sheets

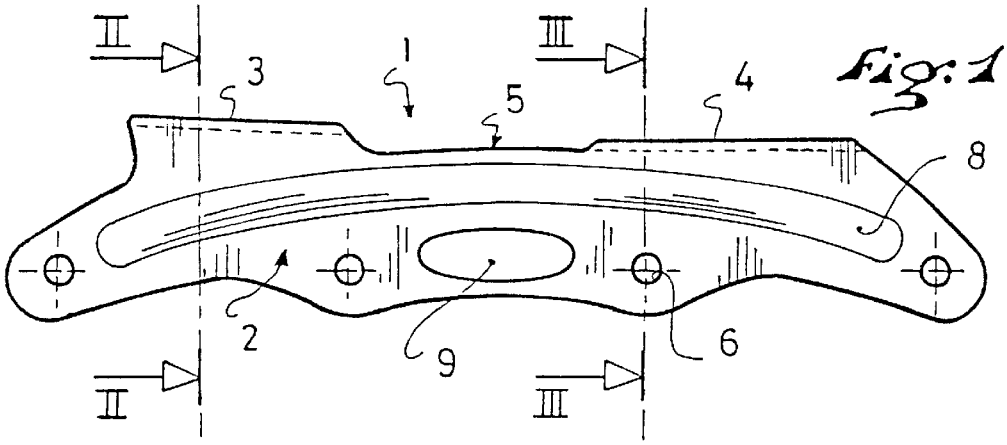
Fig: 1
Fig: 2
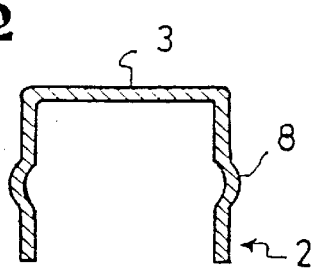
Fig: 3
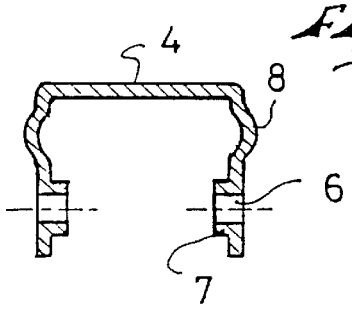
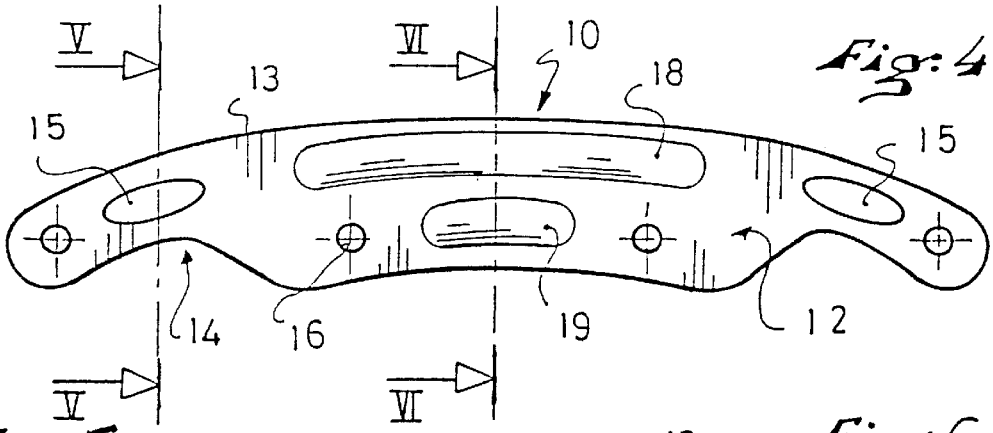
Fig: 4
Fig: 5
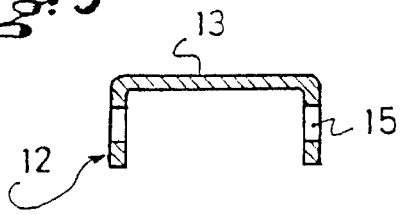
Fig: 6
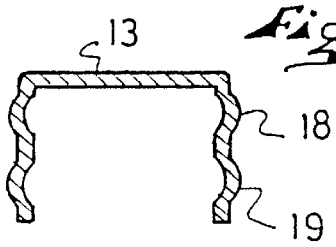

CHASSIS FOR A GLIDING SPORT ELEMENT, SUCH AS A SKATE, AND A GLIDING ELEMENT INCLUDING SUCH CHASSIS

CROSS-REFERENCE TO RELATED APPLICATIONS

This application is a division of application Ser. No. 08/736,995, filed on Oct. 25, 1996, the disclosure of which is hereby incorporated by reference thereto in its entirety and the priority of which is claimed under 35 USC 120.

This application is also based upon French application No. 95.13707, filed on Nov. 14, 1995, the disclosure of which is hereby incorporated by reference thereto in its entirety and priority of which is hereby claimed under 35 USC 119.

BACKGROUND OF THE INVENTION

1. Field of the Invention

The present invention relates to chassis for a gliding sport element such as a roller skate or an ice skate, and a gliding sport element including such a chassis.

2. Description of Background and Relevant Information

A chassis of the aforementioned type must ensure the linkage between the gliding member(s) themselves, namely the skate blade, wheels, or rollers, and the user's foot.

The chassis is therefore generally constituted by a support surface that is capable of receiving the boot of the athlete, and by one or two lateral flanges adapted to receive the wheels, rollers, or the blade of the skate.

The chassis must also have substantial characteristics of mechanical resistance while being as light as possible, to avoid the forces imposed by the athlete from being too substantial.

Furthermore, the increasing technicality of these gliding sport elements, especially for in-line roller skates, further increases the conflicting requirements which must be met by the skate chassis, namely:

- an increased mechanical resistance and stability, especially for speed skates, but also for the so-called free ride, free style, or hockey skates;
- some flexibility, especially in certain zones of the skate to enable the shape of the skate to adapt to the path covered, especially in turns at high speed;
- various and original forms the meet e(merging and changing fashion requirements; and
- a lowest possible manufacturing cost.

The techniques used in manufacturing the currently known chassis do not make it possible to meet all of these requirements, while maintaining a reasonable manufacturing cost.

Indeed, the oldest manufacturing technique consists of making such chassis from a U-shaped folded metal sheet, as shown in the document DE 10 33 569, for example.

Such a manufacturing principle, while inexpensive, does not, however, make it possible to obtain a large variety of forms, nor chassis with substantial mechanical resistance, unless the thickness of the metal sheet, and therefore the weight thereof, are substantially increased.

Another commonly used technique consists of making the chassis by molding from a synthetic, or metallic, material. Molding offers the advantage of allowing various forms, but it also has numerous disadvantages:

- the cost of the molds;

- limited selection of materials capable of being molded;
- low mechanical resistance of these molding materials, even when they are metallic; and
- insufficient molding precision, requiring additional machining, especially with respect to alignment of the holes for fixing the wheels or the skate blade on a two-flange chassis.

Chassis made of composite fibers are also known. These chassis can indeed be obtained in almost all possible forms, but their manufacture is extremely expensive and difficult to industrialize. Furthermore, while such chassis are extremely rigid, they lack flexibility and are therefore fragile and "uncomfortable."

Finally, U.S. Pat. No. 5,388,846 has proposed to make a chassis for ice skates or roller skates from a profiled metallic bar whose transverse cross section corresponds to the general section desired for the chassis, the final form of the chassis being obtained after machining with removal of material.

Such a manufacturing method is also very expensive, due to the necessary machining period and the quantity of material to be removed. It does not allow for a great freedom with respect to the form or profile of the chassis.

SUMMARY OF THE INVENTION

An object of the present invention is to remedy the aforementioned drawbacks and to provide an improved chassis for a gliding sport element, as well as a gliding sport element, such as an in-line skate, employing such improved chassis, which resolves the various aforementioned problems and, in particular, to reconcile the characteristics of mechanical resistance, adaptability, flexibility, lightness, and a low manufacturing cost.

The chassis of the gliding element according to the invention is made by cutting from a metallic flank a form corresponding substantially the developed or completed, form of at least one portion of the chassis, and obtaining at least one stiffening rib by pressing such portion of the chassis.

Indeed, stiffening the chassis by means of one or more stiffening ribs by pressing enables, at equal weight with respect to a chassis merely obtained by bending, a substantial increase in the characteristics of rigidity and resistance to deformation due, on the one hand, to the presence of such ribs, but also to the localized work hardening of the material obtained in the area of such ribs related to the manufacturing method by pressing.

Depending on the desired results, one can provide each rib to extend substantially along the entire length of the flange of the chassis, or only over a limited central zone of each flange, or yet in the area of the ends of each flange.

BRIEF DESCRIPTION OF THE DRAWINGS

The invention will be better understood and other characteristics will become apparent along the description that follows, with reference to the annexed schematic drawing showing, by way of non-limiting examples, a plurality of embodiments of the chassis, and in which:

FIG. 1 is a side view of a chassis according to a first embodiment;

FIG. 2 is a cross-sectional view along the line II—II of FIG. 1;

FIG. 3 is a cross-sectional view along the line III—II of FIG. 1;

FIG. 4 is a side view of a chassis according to a second embodiment;

FIG. 5 is a cross-sectional view along the line V—V of FIG. 4;

FIG. 6 is a cross-sectional view along the line VI—VI of FIG. 4;

DETAILED DESCRIPTION OF THE INVENTION

Figure 7:
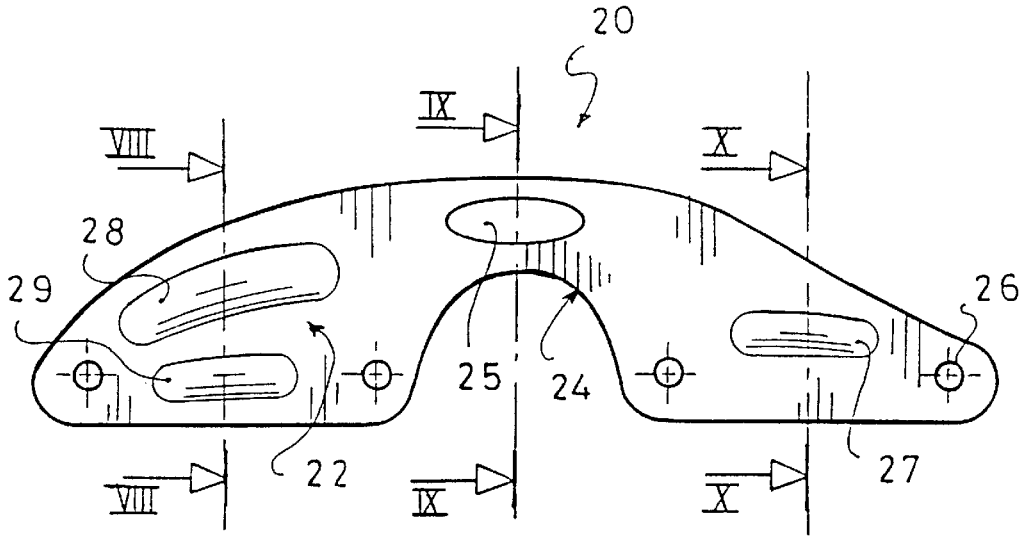
FIG. 7 is a side view of a chassis according; to a third embodiment.
Figure 8:
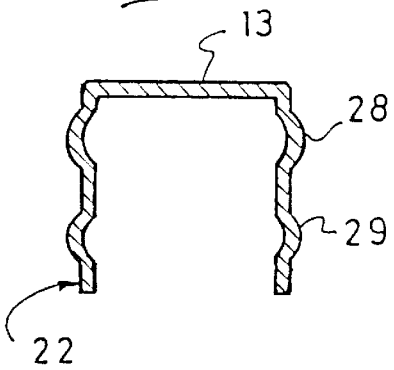
FIG. 8 is a cross-sectional view along the line VII—VII of FIG. 7.
Figure 9:
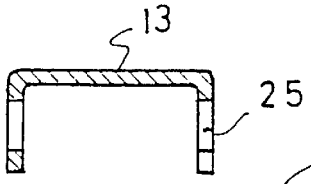
FIG. 9 is a cross-sectional view along the line IX—IX of FIG. 7.
Figure 10:
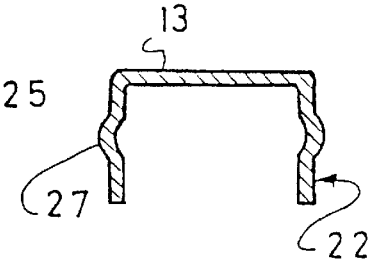
FIG. 10 is a cross-sectional view along the line X—X of FIG. 7.

As shown in FIGS. 1–3, the chassis according to the invention is made from a metal sheet, and has the general form of two lateral flanges 2 connected to each other by two platforms 3, 4, providing the assembly with a substantially U-shaped transverse section.

Each of the platforms 3, 4 constitutes a support surface capable of receiving the boot of the athlete, the latter (not shown in the drawing) being fixed by any known means, especially glue, rivets, screws, etc., but it can also be fixed removably by non-permanent connection means.

One will also note that the platforms 3, 4 are distinct and separated from one another by a cutout 5, and they are located at different levels in height, the front platform 4 being lower than the rear platform 3, to take into account the natural position of the athlete, in which the heel is slightly raised.

Each flange 2 has an elongated form that is bent in an arc of a circle in the longitudinal direction.

Holes 6 for the attachment of the rollers or of the skate blade, as the case may be, are provided at the lower end of each flange.

Each hole 6 is made in a cylindrical boss 7 that can be obtained by die forging. The holes 6 located correspondingly in the two flanges are coaxial.

Each flange 2 further has a pressed rib 8 that extends substantially along the entire length of the flange 2, above the attachment holes 6, and has a generally arched shape.

As shown particularly in FIGS. 2 and 3, each rib 8 has a substantially constant thickness corresponding to that of the metal sheet constituting the flanges 2 and each of the platforms 3, 4, and it has a recessed form which is curved outwardly, this recessed form and the constant thickness being characteristic of a form obtained by pressing.

Furthermore, the rib 8 has a longitudinal extent that varies in vertical position and extends other than along a single straight line along the entirety of its length. In the particular illustrated embodiment, each rib 8 preferably follows the contour of the flanges 1, 2, on which it is pressed and therefore has, in this case, an elongated form which is also slightly curved continuously in the longitudinal direction, a center portion being relatively raised, i.e., at a higher elevation, with respect to a straight line connecting opposite end portions.

Such a pressed rib 8 provide the flange, on which it is obtained, a substantial increase in the moment of inertia and of the resistance to deformation both in the longitudinal and vertical directions, this increase being related not only to the presence of each rib 8 and to the shape thereof, but also to the work hardening of the material in the rib area during the pressing operation.

Such a construction and manufacturing concept practically make it possible to divide in two the thickness and therefore, the weight, of the metal sheet used to make the chassis with respect to a bent, molded, or profiled chassis, while maintaining, or even increasing, the mechanical characteristics.

This method results in an extremely light, resistant, and inexpensive chassis.

Advantageously, the chassis will be made from laminated metal sheet whose fibers are oriented along the longitudinal direction of the chassis. Such a characteristic also makes it possible to increase the resistance qualities of the chassis in the longitudinal direction, especially with respect to a chassis made of an injected or cast alloy in which there is no formation of fibers.

Furthermore, it is possible to modify the moment of inertia of the chassis by providing appropriate cutouts such as 5, 9. As shown, these cutouts are perimetric, i.e., they are through holes that are completely contained within the outer boundaries of the chassis.

In the present case, the cutout 9, which is oval and arranged centrally beneath the rib 8, makes it possible to reduce the flexional stiffness of each flange 2 in the central zone of the chassis and, in combination with the cutout 5 which also arranged centrally, also makes it possible to reduce the flexional stiffness of the entire chassis in this zone. In the embodiment of FIG. 1, the cutout 9 extends longitudinally between the two intermediate holes 6, the rib 8 extending above the cutout and beyond the intermediate holes 6.

Such a chassis can be obtained very simply and in a single piece from a metallic flank, or sheet in a succession of steps, such as the following:

- first, the sheet is precut in a form corresponding to the completed form of the chassis with an increased surface in the zone of each rib to take into account the shrinking of material during the pressing;
- all cutouts such as 5 and 9 are also obtained during this first die cutting operation;
- the two ribs 8 of the two flanges 1, 2 are then obtained by pressing;
- the holes 6 are then obtained by extrusion and are possibly threaded, after a preliminary die forging of the bosses 7;
- the metal sheet is finally bent or folded into a U-shape.

Of course, the series of operations described above only applies if the chassis is made in a single piece from the same metallic sheet.

It can also be obtained in a plurality of portions assembled by any known means, such as screws, rivets, welds, etc.

More particularly, each chassis can be constituted by two flanges having a generally "L"-shaped transverse section and being connected to one another by the small arm of each "L".

With respect to an aluminum chassis made of an alloy obtained by injection during molding, such a manufacturing technique by pressing, and possibly by die forging, bending, is much more precise, does not require any subsequent machining, and makes it possible to have a greater selection of material, with more interesting characteristics. Indeed, the number of available materials for injection or molding is very limited, and these materials are generally brittle and do not promote the formation of fibers.

Moreover, since the molding and injection techniques are not sufficiently precise, time-consuming, and expensive additional machining would be necessary to obtain the holes for attaching the gliding member(s), for example.

One will also note that the geometrical properties of a pressed chassis are clearly greater than those of a chassis made out of plastic materials, in which, due to the shrinking of the material, one is confronted with the phenomena of twisting and alignment of the wheels' attachment holes, thereby requiring additional machining.

By way of example, the necessary periods to produce a chassis using the various techniques can be assessed as follows:

| | |
|---|---|
| plastic materials | 15 seconds |
| profiled and machined aluminum | 180 seconds |
| cast aluminum | 85 seconds |
| pressed aluminum | 6 seconds |

Therefore, one notes the triple gain, in terms of the manufacturing time and cost, characteristics of the material and lightness, that is made by using the technique according to the invention.

Another extremely advantageous characteristic of the pressing technique resides in the fact that the possibilities in terms of design are greater than those of the aluminum profile that does not allow any embossing or form on the sheets of the profile which are necessarily planar.

Furthermore, the method and construction according to the invention offer greater possibilities in varying the moment of inertia of the chassis along the longitudinal axis thereof, by providing adapted ribs, cutouts, or heights of the sheets, in order to obtain a deformation of the chassis and an optimum behavior of the chassis as a function of the desired practice.

Thus, the chassis described with reference to FIGS. 1–3 offers a quasi uniform rigidity along its entire length, whereas the other two examples of chassis shown in FIGS. 4–6 and 7–10 make it possible to obtain different characteristics.

The chassis 10 shown in FIGS. 4–6 includes, as is the case for the chassis 1, two lateral flanges 12, but a single platform 13 extending along its entire length.

The chassis 10 further has a form that is clearly curved in a arc of a circle.

Each flange 12 has at each end a cutout 15 as well as a perimetric narrowing 14 providing it with flexibility and a low moment of inertia in these zones.

Conversely, each flange 12 is provided in its median zone with two superimposed pressed ribs 18, 19.

Such a chassis therefore has a very substantial rigidity in the center, in the zone of ribs 18, 19, and relatively flexible ends.

The chassis 20 shown in FIGS. 7–10 includes, as is the case for the chassis 10, two lateral flanges 22 and a single platform 13 extending along its entire length.

It also had the shape of an arc of a circle. Each flange 22 has:

two superimposed ribs 28, 29 at its rear end, at least the rib 28 extending forwardly in a continuous curved shape;

a cutout 25 and a perimetric narrowing 24 in its central zone; and a single rib 27 at its front end.

Such a chassis will therefore be very rigid at the rear, very flexible in the center, and moderately rigid at the front.

Each of the ribs 8, 18, and 28 of the examples of the invention described above extends longitudinally at a variable height relative to a line that connects the opposite ends of the ribs. Further, each of ribs 8, 18, and 28 is downwardly incurved.

Figure 11:
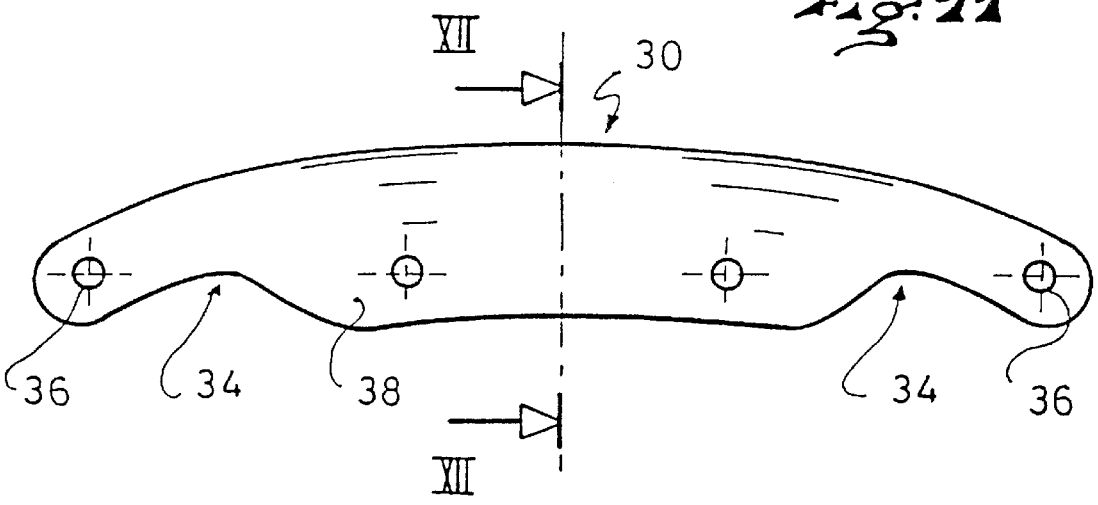
FIG. 11 is a side view of a chassis according to a fourth embodiment.
Figure 12:
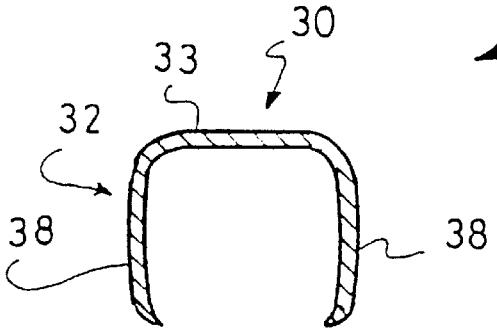
FIG. 12 is a cross-sectional view along the line XII—XII of FIG. 11.
Figure 13:
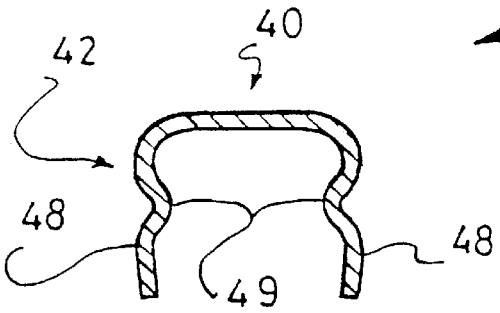
FIG. 13 is a view similar to FIG. 12 showing yet another embodiment.

FIGS. 11–13 show other embodiments of a chassis.

In the case of FIGS. 11 and 12, each lateral flange 32 of the chassis 30 is pressed over its entire surface and, therefore, constitutes a large and single rib 38 which is slightly bent outwardly.

Therefore, such a chassis has particularly homogeneous characteristics of torsional and flexional rigidity along its entire length, the only more flexible zones being defined at the front and rear by scallops 34.

Finally, FIG. 13 shows yet another example of cross pressing of the lateral flanges 42 of a chassis 40, in which each flange is pressed outwardly a first time, then inwardly a second time, thus defining two external "ribs" 48 and an internal 19 median rib 49.

Of course, a simple pressing of each internal rib 49 is also possible.

The present invention is not limited to the particulars of the examples described hereinabove. It can apply to any chassis for any sport element that must meet the same requirements.

What is claimed is:

1. A chassis for a gliding sport element, said chassis comprising:

at least one support surface adapted to support a boot;

at least one longitudinally extending lateral flange extending downwardly from said support surface, said at least one lateral flange being adapted to have attached at least one gliding member;

said at least one lateral flange comprising at least one longitudinally extending stiffening rib, made by pressing, on said at least one lateral flange, said stiffening rib having a pair of opposite ends, an intermediate portion extending longitudinally between said opposite ends, said intermediate portion extending longitudinally along said at least one flange other than in a single straight line between said opposite ends at a variable vertical position and at a higher elevation relative to a straight line connecting said opposite ends.

2. A chassis according to claim 1, wherein:

said stiffening rib has a longitudinally extending curved shape.

3. A chassis according to claim 2, wherein:

said at least one lateral flange includes a front end portion and a rear end portion;

said front end portion includes top and bottom edges, both of said top and bottom edges of said front end portion extending both forwardly and downwardly; and said rear end portion includes top and bottom edges, both of said top and bottom edges of said rear end portion extending both rearwardly and downwardly.

4. A chassis according to claim 2, wherein:

said at least one flange comprises means for attaching said at least one gliding member to said at least one flange, said means being arranged longitudinally along said at least one flange; and said stiffening rib is positioned above said means for attaching.

5. A chassis according to claim 4, wherein:

said stiffening rib comprises opposite ends, said stiffening rib being continuous between said opposite ends.

6. A chassis according to claim 1, wherein:

said stiffening rib on said at least one flange extends along substantially an entirety of said at least one flange.

7. A chassis according to claim 1, wherein:

said stiffening rib on said at least one flange extends along a limited central zone of said at least one flange.

8. A chassis according to claim 1, wherein;

said stiffening rib on said at least one flange extends along substantially an entirety of said at least one flange, but less than along said entirety of said at least one flange, thereby leaving longitudinally extending opposite end portions of said at least one flange substantially flat.

9. A chassis according to claim 1, wherein:

said at least one flange includes a cutout.

10. A chassis according to claim 9, wherein:

said at least one stiffening rib is positioned above said cutout.

11. A chassis according to claim 10, wherein:

said cutout, above which said stiffening rib is positioned, is a perimetric opening.

12. A chassis according to claim 11, wherein:

said at least one lateral flange includes a series of at least four longitudinally spaced apart holes for attachment of said gliding member, said stiffening rib extending longitudinally along a length at least equal to a distance between two successive ones of said holes.

13. A chassis according to claim 11, wherein:

said at least one lateral flange includes a series of at least four longitudinally spaced apart holes for attachment of said gliding member;

said opening extends longitudinally between two successive intermediately positioned ones of said holes; and said stiffening rib extends longitudinally beyond said two successive intermediately positioned ones of said holes.

14. A chassis according to claim 10, wherein:

said cutout of said at least one flange is positioned substantially in a longitudinally central position of said flange, with said rib extending longitudinally beyond said centrally positioned cutout forwardly and rearwardly.

15. A chassis according to claim 1, wherein;

said at least one stiffening rib includes a stiffening rib positioned in areas of respective longitudinal ends of said at least one flange.

16. A chassis according to claim 1, wherein:

said at least one stiffening rib projects inwardly of said chassis.

17. A chassis according to claim 1, wherein:

said at least one stiffening rib projects outwardly of said chassis.

18. A chassis according to claim 1, wherein:

said at least one lateral flange comprises a pair of laterally spaced apart lateral flanges, said chassis having a substantially U-shaped transverse cross section taken through said support surface.

19. A chassis according to claim 18, wherein:

said pair of laterally spaced apart lateral flanges are made of metal.

20. A chassis according to claim 19, wherein:

said metal is aluminum.

21. A chassis according to claims, wherein:

said at least one lateral flange comprises a pair of laterally spaced apart lateral flanges, each of said flanges having a said stiffening rib;

said chassis further comprising a front platform and a rear platform, said front and rear platforms comprising said at least one support surface adapted to support a boot;

each of said pair of flanges extending downwardly from said front and rear platforms, whereby said pair of flanges and said platforms comprise, in transverse cross section, a substantially U-shape.

22. A chassis according to claim 21, wherein:

said front platform comprises a forwardmost edge and said rear platform comprises a rearwardmost edge; and each said stiffening rib of a respective said flange extends at least substantially from said forwardmost edge to substantially said rearwardmost edge.

23. A chassis according to claim 21, wherein:

said front and rear platforms and said pair of flanges are formed of a single piece.

24. A chassis according to claim 1, wherein:

said at least one support surface adapted to support a boot is formed by at least one support platform, said at least one platform having a forwardmost edge and a rearwardmost edge; and each said stiffening rib of a respective said flange extends at least substantially from said forwardmost edge to substantially said rearwardmost edge.

25. A chassis according to claim 1, wherein:

said at least one flange is made of metal.

26. A chassis according to claim 25, wherein:

said metal is aluminum.

27. A chassis for a gliding sport element, said chassis comprising:

at least one support surface adapted to support a boot;

at least one longitudinally extending lateral flange extending downwardly from said support surface, said at least one lateral flange being adapted to have attached at least one gliding member;

said at least one lateral flange comprising at least one longitudinally extending stiffening rib on said at least one lateral flange, said at least one stiffening rib projecting transversely of a surrounding surface of a respective said lateral flange;

said stiffening rib having a longitudinally extending, downwardly facing incurved shape and extending between opposite ends and rising to a higher elevation relative to a straight line connecting said opposite ends.

28. A chassis for a gliding sport element, said chassis comprising:

at least one support surface adapted to support a boot;

at least one longitudinally extending lateral flange extending downwardly from said support surface, said at least one lateral flange being adapted to have attached at least one gliding member;

said at least one lateral flange comprising at least one longitudinally extending stiffening rib, made by pressing, on said at least one lateral flange, said stiffening rib on said at least one flange extending longitudinally along substantially an entirety of said at least one flange, but less than along said entirety of said at least one flange, thereby leaving longitudinally extending opposite end portions of said at least one flange substantially flat, said stiffening rib having a pair of longitudinally opposed ends and extending longitudinally from one of said ends and rising to a higher elevation relative to a straight line connecting said opposed ends, said stiffening rib having a downwardly facing incurved shape.

29. A chassis according to claim 28, wherein:

said at least one lateral flange comprises a pair of laterally spaced apart lateral flanges, said chassis having a substantially U-shaped transverse cross section taken through said support surface.

30. A chassis according to claim 28, wherein:

said at least one lateral flange comprises a pair of laterally spaced apart lateral flanges, each of said flanges having a said stiffening rib;

said chassis further comprising a front platform and a rear platform, said front and rear platforms comprising said at least one support surface adapted to support a boot;

each of said pair of flanges extending downwardly from said front and rear platforms, whereby said pair of flanges and said platforms comprise, in transverse cross section, a substantially U-shape.

31. A chassis for a gliding sport element, said chassis comprising:

at least one support surface adapted to support a boot;

at least one longitudinally extending lateral flange extending downwardly from said support surface, said at least one lateral flange being adapted to have attached at least one gliding member;

said at least one lateral flange comprising a longitudinally elongated cutout;

said at least one lateral flange further comprising at least one longitudinally extending stiffening rib, made by pressing, positioned above said elongated cutout;

said stiffening rib having a pair of opposite ends, an intermediate portion extending longitudinally between said opposite ends, said intermediate portion extending longitudinally along said at least one flange in a path other than a single straight line between said opposite ends, said path of said intermediate portion of said stiffening rib having a variable vertical position and a higher elevation relative to a straight line connecting said opposite ends.

32. A chassis according to claim 31, wherein:

said cutout on said at least one lateral flange, above which said stiffening rib is positioned, is a perimetric opening.

33. A chassis according to claim 32, wherein:

said at least one lateral flange includes a series of at least four longitudinally spaced apart holes for attachment of said gliding member, said stiffening rib extending longitudinally along a length at least equal to a distance between two successive ones of said holes.

34. A chassis according to claim 32, wherein:

said at least one lateral flange includes a series of at least four longitudinally spaced apart holes for attachment of said gliding member;

said opening of said at least one lateral flange extends longitudinally between two successive intermediately positioned ones of said holes; and said stiffening rib of said at least one lateral flange extends longitudinally beyond said two successive intermediately positioned ones of said holes.

35. A chassis according to claim 31, wherein:

said cutout of said at least one flange is positioned substantially in a longitudinally central position of said flange, with a respective said rib extending longitudinally beyond said centrally positioned cutout forwardly and rearwardly.

36. A gliding sport element comprising:

chassis comprising:

at least one support surface adapted to support a boot;

at least one longitudinally extending lateral flange extending downwardly from said support surface, said at least one lateral flange being adapted to have attached at least one gliding member;

said at least one lateral flange comprising at least one longitudinally extending stiffening rib, made by pressing, on said at least one lateral flange, said stiffening rib having a pair of opposite ends and extending longitudinally from one of said opposite ends and rising to a higher elevation relative to a straight line connecting said opposite ends, said stiffening rib having a downwardly facing incurved shape;

a boot supported upon said at least one support surface of said chassis; and at least one gliding member attached to said at least one lateral flange.

37. A gliding sport element according to claim 36, wherein:

said gliding element is an in-line roller skate, said at least one gliding member comprising a plurality of in-line wheels.

38. A gliding sport element according to claim 36, further comprising:

at least one cutout extending through said at least one lateral flange.

39. A gliding sport element according to claim 38, wherein:

said cutout is elongated.

40. A gliding sport element according to claim 38, wherein;

said at least one lateral flange includes a plurality of longitudinally spaced holes, independent of said cutout;

said at least one gliding member is attached to said at least one lateral flange with an attachment member extending through respective ones of said plurality of longitudinally spaced holes.

41. A gliding sport element according to claim 40, wherein:

said at least one cutout is positioned above said attachment members.

42. A gliding sport element according to claim 36, wherein:

said at least one lateral flange comprises a pair of laterally spaced apart lateral flanges, said chassis having a substantially U-shaped transverse cross section taken through said support surface.

43. A gliding sport element according to claim 36, wherein:

said at least one lateral flange comprises a pair of laterally spaced apart lateral flanges, each of said flanges having a said stiffening rib;

said chassis further comprising a front platform and a rear platform, said front and rear platforms comprising said at least one support surface adapted to support a boot;

each of said pair of flanges extending downwardly from said front and rear platforms, whereby said pair of flanges and said platforms comprise, in transverse cross section, a substantially U-shape.

* * * * *